US010480164B2

(12) United States Patent
Hu et al.

(10) Patent No.: US 10,480,164 B2
(45) Date of Patent: Nov. 19, 2019

(54) TOUCH TO OPEN/CLOSE MECHANISM FOR A SHOWERHEAD

(71) Applicant: RUNNER (XIAMEN) CORP., Xiamen (CN)

(72) Inventors: Xin-Zhan Hu, Xiamen (CN); Chun-Hui Lin, Xiamen (CN)

(73) Assignee: RUNNER (XIAMEN) CORP., Xiamen (CN)

( * ) Notice: Subject to any disclaimer, the term of this patent is extended or adjusted under 35 U.S.C. 154(b) by 0 days.

(21) Appl. No.: 15/864,693

(22) Filed: Jan. 8, 2018

(65) Prior Publication Data

US 2018/0195257 A1 Jul. 12, 2018

(30) Foreign Application Priority Data

Jan. 11, 2017 (CN) ..... 2017 2 0027115 U

(51) Int. Cl.

| | |
|---|---|
| ***E03C 1/04*** | (2006.01) |
| ***B05B 1/18*** | (2006.01) |
| ***B05B 1/16*** | (2006.01) |
| ***B05B 15/654*** | (2018.01) |

(52) U.S. Cl.

CPC ..... *E03C 1/0409* (2013.01); *B05B 1/1627* (2013.01); *B05B 1/185* (2013.01); *B05B 15/654* (2018.02); *E03C 1/0408* (2013.01)

(58) Field of Classification Search

CPC ..... E03C 1/0408; E03C 1/0409; B05B 1/18; B05B 1/185; B05B 1/1627; B05B 1/1663; B05B 1/1681; B05B 15/654

See application file for complete search history.

(56) References Cited

U.S. PATENT DOCUMENTS

| | | | | |
|---|---|---|---|---|
| 8,113,442 | B2 * | 2/2012 | Li | B05B 1/18 239/11 |
| 8,276,833 | B2 * | 10/2012 | Cheng | E03C 1/0409 239/436 |
| 8,925,583 | B2 * | 1/2015 | Zhou | B05B 1/1636 137/625.11 |
| 9,144,808 | B2 * | 9/2015 | Zhou | B05B 1/18 |
| 9,233,379 | B2 * | 1/2016 | Zhou | B05B 1/18 |
| 9,278,364 | B2 * | 3/2016 | Zhou | B05B 1/1636 |
| 9,470,334 | B2 * | 10/2016 | Zhou | F16K 31/44 |
| 9,616,434 | B2 * | 4/2017 | Pan | B05B 1/1636 |
| 10,060,105 | B2 * | 8/2018 | Lin | B05B 1/18 |
| 10,203,038 | B2 * | 2/2019 | Lin | F16K 31/524 |
| 2012/0318391 | A1 * | 12/2012 | Zhou | E03C 1/08 137/625.46 |

(Continued)

*Primary Examiner* — Steven J Ganey
*Assistant Examiner* — Steven M Cernoch
(74) *Attorney, Agent, or Firm* — Chun-Ming Shih

(57) ABSTRACT

A touch to open/close mechanism for a showerhead includes a driving rod movably and reciprocally positioned between a first position and a second position to selectively block communication between the inlet and the outlet; a first ratchet device adapted to be formed inside the showerhead to selectively position the driving rod at the first position and the second position; and a second ratchet device adapted to be formed inside the showerhead to force the driving rod to rotate for a previously determined degree whenever the driving rod is moved such that a block formed on an outer periphery of the driving rod is able to selectively block communication between the inlet and the outlet.

6 Claims, 3 Drawing Sheets

(56) References Cited

U.S. PATENT DOCUMENTS

| | | | | |
|---|---|---|---|---|
| 2013/0161549 | A1* | 6/2013 | Zhou | B05B 1/18 251/213 |
| 2016/0184840 | A1* | 6/2016 | Yu | B05B 1/18 239/447 |
| 2016/0340877 | A1* | 11/2016 | Lin | E03C 1/0408 |
| 2018/0058048 | A1* | 3/2018 | Hu | E03C 1/0409 |

* cited by examiner

TOUCH TO OPEN/CLOSE MECHANISM FOR A SHOWERHEAD

BACKGROUND OF THE INVENTION

1. Field of the Invention

The present invention relates to a touch to open/close mechanism and, more particularly, to a touch to open/close mechanism for a showerhead.

2. Description of Related Art

Nowadays, people take a shower routinely to clean the body and wash away daily fatigue. While taking a shower, it is always happy to use the variously-designed outlet panel to enjoy jets of different strengths. When turning on the showerhead, when the conventional control knob is used, the user sometimes will go through a difficult time searching for the whereabout of the control knob. To obviate the shortcoming of this design, a novel design is created for the user to easily control the open and close of the showerhead. That is, a touch-to-control type of showerhead is commercially available to allow the user only to know the general direction of this type of showerhead and the user is able to control the open/close of the showerhead. In another word, the open/close switch mechanism is directly mounted on the showerhead so that a gentle touch to the switch alternately closes and opens the showerhead. Users will never go through the difficult search for the control of the showerhead even users' eyes are blinded by foam. Despite all the advantages of this touch-to-control switch, problems still arise in that when the water pressure from the water source is unstable, the user might have to apply different strengths to activate the touch-to-control switch as when the water pressure from the water source is high, the user might experience difficulty pressing down the switch and when the water pressure from the water source is low, the user is able to easily press down the switch. The difference between applied forces might sometimes cause a great deal of troubles for the user especially when the users' both hands are covered with soap.

In order to mitigate the situation, it is an objective of the embodiment of the present invention to provide a touch to open/close mechanism for a showerhead without the influence of water pressure from the water source.

SUMMARY OF THE INVENTION

It is an objective of the embodiment of the present invention to provide a touch to open/close mechanism for a showerhead.

An objective of the preferred embodiment of the present invention is to provide a touch to open/close mechanism adapted for a showerhead having an inlet and at least one outlet in communication with the inlet to allow water from water source to flow out of the showerhead, the touch to open/close mechanism comprising a driving rod movably and reciprocally positioned between a first position and a second position to selectively block communication between the inlet and the outlet; a first ratchet device adapted to be formed inside the showerhead to selectively position the driving rod at the first position and the second position; and a second ratchet device adapted to be formed inside the showerhead to force the driving rod to rotate for a previously determined degree whenever the driving rod is moved such that a block formed on an outer periphery of the driving rod is able to selectively block communication between the inlet and the outlet.

Another objective of the preferred embodiment of the present invention is that the mechanism further comprises a pivot pad adapted to be pivotally connected to the showerhead; and a rocking arm connected to the pivot pad to be driven to move by pivotal movement of the pivot pad and having a limiting path defined in a side face thereof to receive therein a first distal free end of the driving rod such that the driving rod is moved resulting from the movement of the rocking arm.

Another objective of the preferred embodiment of the present invention is that the mechanism further comprises a recoil force device compressed by the movement of the driving rod to selectively release a recoil force to the driving rod to return the driving rod.

Another objective of the preferred embodiment of the present invention is that the mechanism further comprises a passage body adapted to be mounted inside the showerhead and a mounting body adapted to be mounted inside the showerhead and securely connected to the passage body to define therebetween a first chamber to receive therein the driving rod.

Another objective of the preferred embodiment of the present invention is that the mechanism further comprises a pivot pad adapted to be pivotally connected to the showerhead; a rocking arm connected to the pivot pad to be driven to move by pivotal movement of the pivot pad and having a limiting path defined in a side face thereof to receive therein a first distal free end of the driving rod such that the driving rod is moved resulting from the movement of the rocking arm; a passage body adapted to be mounted inside the showerhead; a mounting body adapted to be mounted inside the showerhead and securely connected to the passage body to define therebetween a first chamber to receive therein the driving rod; and a distributor securely attached to a side face of the mounting body and firmly connected to a second free end of the driving rod and having at least one first passage adapted to communicate with the outlet of the showerhead; wherein a free end of the recoil force device is abutted against a side face of the distributor to provide the recoil force to return the driving rod.

Another objective of the preferred embodiment of the present invention is that the mechanism further comprises a pivot pad adapted to be pivotally connected to the showerhead; a rocking arm connected to the pivot pad to be driven to move by pivotal movement of the pivot pad and having a limiting path defined in a side face thereof to receive therein a first distal free end of the driving rod such that the driving rod is moved resulting from the movement of the rocking arm; a passage body adapted to be mounted inside the showerhead; a mounting body adapted to be mounted inside the showerhead and securely connected to the passage body to define therebetween a first chamber to receive therein the driving rod; a distributor securely attached to a side face of the mounting body and firmly connected to a second free end of the driving rod and having at least one first passage adapted to communicate with the outlet of the showerhead; wherein a free end of the recoil force device is abutted against a side face of the distributor to provide the recoil force to return the driving rod; and a sealing cover provided to enclose therein the distributor and the recoil force device; wherein the first ratchet device is formed between the passage body and the mounting body and the second ratchet device is formed between the distributor and the sealing cover.

Another objective of the preferred embodiment of the present invention is that the mechanism further comprises a passage body adapted to be mounted inside the showerhead; a mounting body adapted to be mounted inside the showerhead and securely connected to the passage body to define therebetween a first chamber to receive therein the driving rod; wherein the first ratchet device is formed between the passage body and the mounting body and the second ratchet device is formed between the distributor and the sealing cover, the first ratchet device consists essentially of a first set of ratchet formed on a side face of the passage body and a second set of ratchet formed on an outer periphery of the driving rod to selectively abutted against the first set of ratchet so as to selectively block communication between the inlet and outlet of the showerhead.

Another objective of the preferred embodiment of the present invention is that the mechanism further comprises a passage body adapted to be mounted inside the showerhead; a mounting body adapted to be mounted inside the showerhead and securely connected to the passage body to define therebetween a first chamber to receive therein the driving rod; a distributor securely attached to a side face of the mounting body and firmly connected to a second free end of the driving rod and having at least one first passage adapted to communicate with the outlet of the showerhead; wherein a free end of the recoil force device is abutted against a side face of the distributor to provide the recoil force to return the driving rod; a sealing cover provided to enclose therein the distributor and the recoil force device; and a recoil force device sandwiched between the distributor and the sealing cover to be compressed by the movement of the driving rod to selectively release a recoil force to return the driving rod, wherein the first ratchet device is formed between the passage body and the mounting body and the second ratchet device is formed between the distributor and the sealing cover, the first ratchet device consists essentially of a first set of ratchets formed on a side face of the passage body and a second set of ratchets formed on an outer periphery of the driving rod to selectively abutted against the first set of ratchets so as to selectively block communication between the inlet and outlet of the showerhead, the second ratchet device consists essentially of a third set of ratchets formed on a side face of the distributor and a fourth set of ratchets formed on a side face of the sealing cover to correspond to the third set of ratchets of the distributor to force the distributor as well as the driving rod to rotate for a previously determined degree.

Another objective of the preferred embodiment of the present invention is that the mechanism further comprises a pivot pad adapted to be pivotally connected to the showerhead; and a rocking arm connected to the pivot pad to be driven to move by pivotal movement of the pivot pad and having a limiting path defined in a side face thereof to receive therein a first distal free end of the driving rod such that the driving rod is moved resulting from the movement of the rocking arm.

DETAILED DESCRIPTION OF THE INVENTION

The technical characteristics and objectives of the present invention can be further understood by the following detailed description of preferred embodiment(s) and related drawings.

Figure 1:
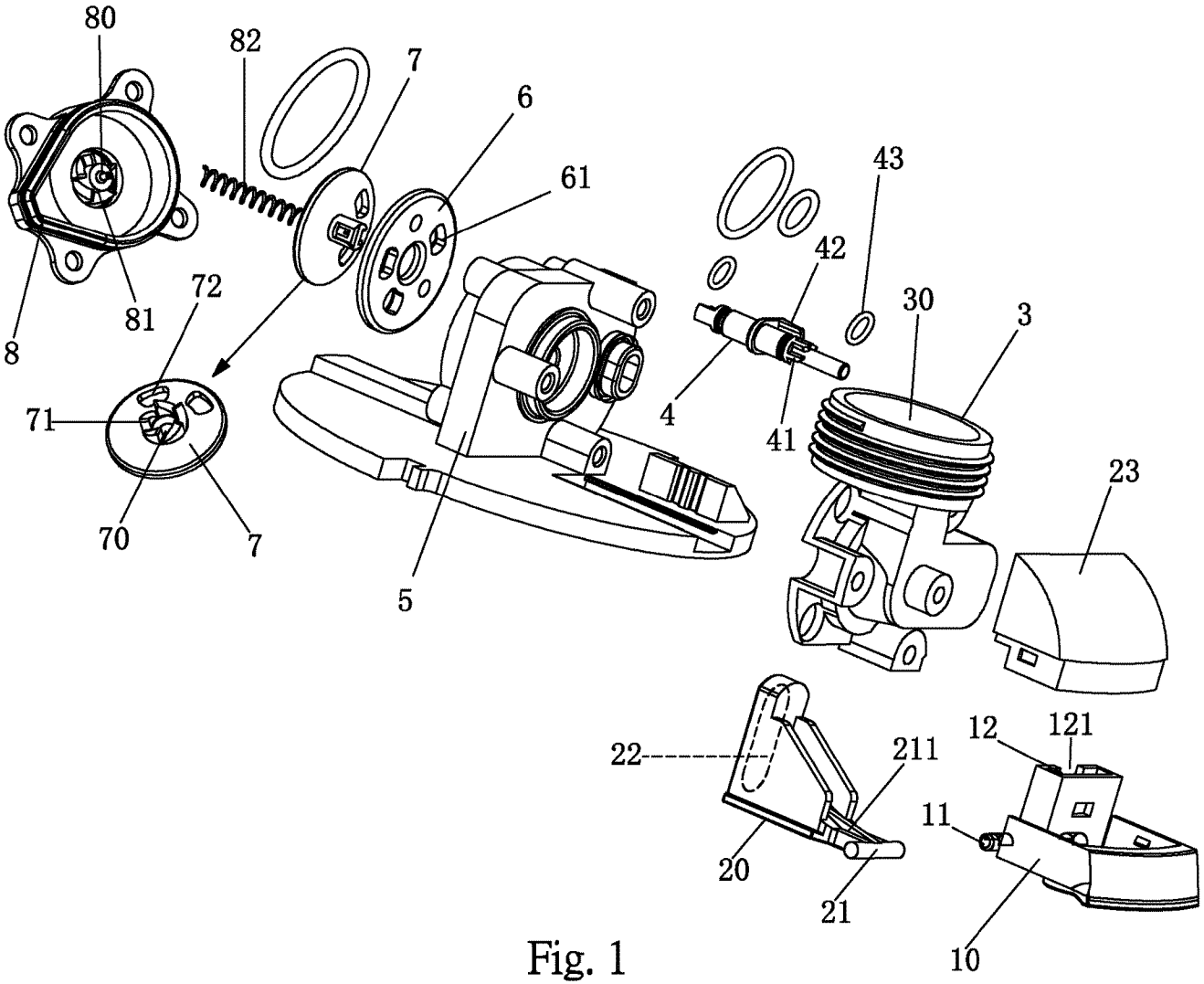
FIG. 1 is an exploded perspective view of the touch to open/close mechanism constructed in accordance with the embodiment of the present invention.
Figure 2:
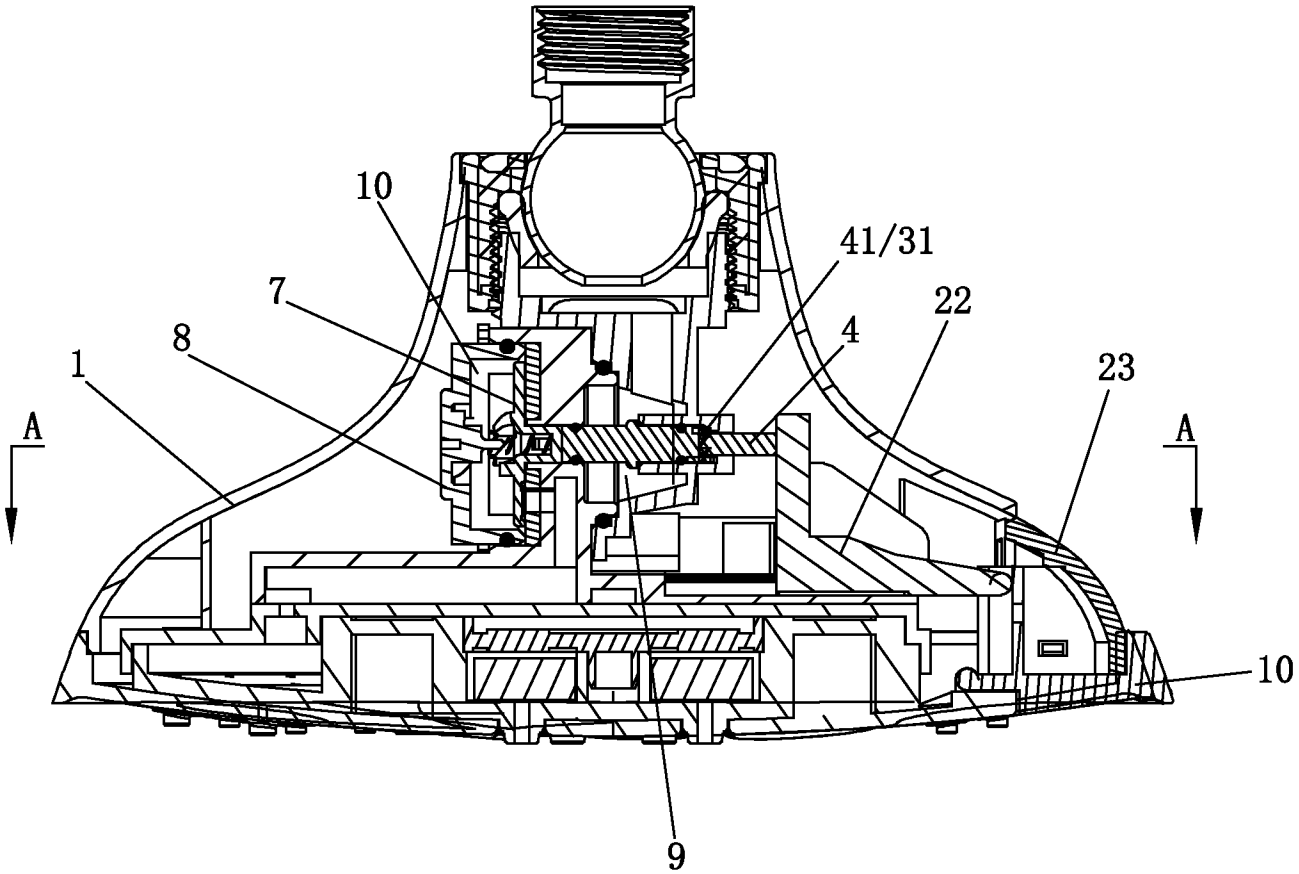
FIG. 2 is a cross sectional view showing the touch to open/close mechanism of the preferred embodiment of the present invention is assembled in a showerhead.

With reference to FIGS. 1 and 2, it is to be noted that a touch to open/close mechanism of the preferred embodiment of the present invention is adapted to be mounted inside a showerhead 1 with orifices (shown in FIG. 2 but not numbered) defined in a front face of the showerhead.

The touch to open/close mechanism of the preferred embodiment of the present invention includes a pivot pad 10 pivotally mounted on the showerhead 1 and having a pivot 11 extending laterally relative to a body of the pivot pad 10 and beyond two opposite sides of the body of the pivot pad 10 so that the pivot 11 is able to snugly fitted into a space defined in the showerhead 1 to allow the pivot pad 10 to pivot relative to the showerhead 1. The pivot pad 10 further has a trough 12 longitudinally defined in a side face thereof to be orthogonal relative to the pivot 11.

A rocking arm 20 is provided inside the showerhead 1 and has an arm integrally formed on a free end thereof to correspond to the trough 12 of the pivot pad 10 and a limiting path 22 defined in a side face thereof. A top cover 23 is provided to securely connect to the pivot pad 10 and cover a portion of the pivot pad 10. Due to the connection between the top cover 23 and the pivot pad 10, when the pivot pad 10 is pivotally moved relative to the showerhead 1, the top cover 23 is moved simultaneously.

A passage body 3 is provided to have an inlet 30 defined in communication with a water source and a first set of ratchets 31 (shown in FIG. 3) formed on an inner side face thereof.

A driving rod 4 is movably received inside the showerhead 1 and has a first free end integrally formed and extending outward through the passage body 3 and into the limiting path 22 of the rocking arm 20, a second set of ratchets 41 formed on an outer periphery thereof to correspond to the first set of ratchets 31 of the passage body 3 and a block 42 integrally formed on the outer periphery of the driving rod 4 and spaced from where the second set of ratchets 41 are formed. A seal 43 is provided to be mounted around the driving rod 4 to be sandwiched between the driving rod 4 and the passage body 3 when the first free end of the driving rod 4 passes through the passage body 3.

A mounting body 5 is provided to securely connected to the passage body 3 and to receive a portion of the driving rod 4 therethrough. A sealing pad 6 is provided to a side of the mounting body 5 to prevent any leakage therebetween and has at least one first passage 61 defined therethrough to correspond to an outlet (not shown) of the mounting body 5.

A distributor 7 is securely attached to the sealing pad 6 and has a third set of ratchets 71 formed around a centrally defined through hole 70 and at least one second passage 72 (two are shown) defined to correspond to the outlets of the mounting body 5. The distributor 7 is rigidly connected to the distal free end of the driving rod 4 such that when the driving rod 4 is moved, the distributor 7 is moved accordingly.

A sealing cover 8 is provided to securely connected to the mounting body 5 and to enclose the distributor 7 and the sealing pad 6 with the mounting body 5. The sealing cover 8 has a centrally formed protrusion 80 corresponding to the through hole 70 of the distributor 7, a fourth set of ratchets 81 formed to correspond to the third set of ratchets 71 of the distributor 7 and a spring 82 one free end of which is mounted around the protrusion 80 and the other free end of which is abutted against a collar (not numbered but shown in FIG. 2) in a periphery defining the through hole 70 of the distributor 7 to always maintain that the distributor 7 is away from the sealing cover 8 and attached to the sealing pad 6.

It is to be noted that when the touch to open/close mechanism of the preferred embodiment of the present invention, which is adapted for a showerhead, is assembled, the pivot pad 10 is pivotally mounted inside the showerhead 1 with the assistance of the pivot axis 11 being inserted into appropriate pivot holes inside the showerhead 1. As forming pivot holes inside the showerhead 1 is conventional in the art, there is no description targeting where and how the pivot holes are formed in the showerhead 1 for brevity. After the pivot pad 10 is pivotally connected to the showerhead 1, the arm 21 of the rocking arm 20 is inserted into the preferably C-shaped, in cross section, trough 12 of the pivot pad 10. As there is an opening 121 in the trough 12 and there is a neck 211 integrally extending out from the rocking arm 20 to connect the arm 21, after the arm 21 is inserted into the trough 12, two opposite sides of the trough 12 are able to limit the arm 21 from escaping away from the trough 12 and the neck 211 is able to move inside the opening 121. Thereafter, the top cover 23 is snap-fit to the pivot pad 10 such that the top cover 23 is able to move along with the pivot pad 10. A limiting path 22 is defined in a side face thereof.

After the mounting body 5 and the passage body 3 are securely mounted on a bottom face of the showerhead 1, a water source (not shown) is connected and in communication with the inlet 30 of the passage body 3 and a first chamber 9 in communication with the inlet 30 of the passage body 3 is defined between the mounting body 5 and the passage body 3, as shown in FIG. 2.

The driving rod 4 is received inside the first chamber 9 and the first set of ratchets 31 of the passage body 3 is mated with the second set of ratchets 41 of the driving rod 4. A second chamber 10 is defined between the mounting body 5 and the sealing cover 8 to communicate with the first chamber 9 via a channel 11. In the meantime, the third set of ratchets 71 of the distributor 7 is mated with the fourth set of ratchets 81 of the sealing cover 8.

Figure 3:
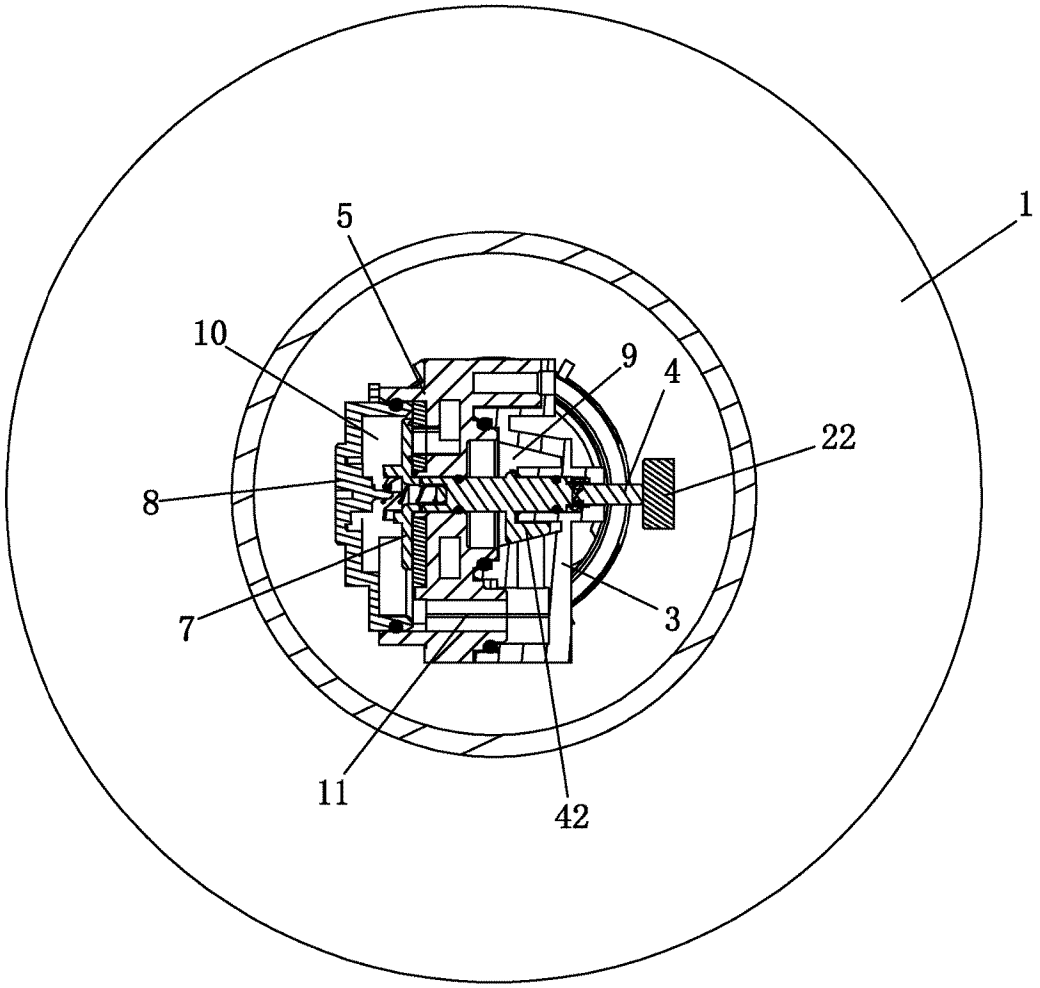
FIG. 3 is another cross-sectional view taking from line A-A in FIG. 2.

With reference to FIGS. 2 and 3, it is appreciated that when the pivot pad 10 is moved by a gentle touch of the user, the movement of the pivot pad 10 drives the rocking arm 20 to move because the arm 21 is received in the trough 12. Thereafter, the rocking arm 20 is moved laterally inside the showerhead 1. And the lateral movement of the rocking arm 20 drives the driving rod 4 to move linearly accordingly as a free end of the driving rod 4 is received in the limiting path 22. Because the passage body 3 is stationary relative to the showerhead 1, the first set of ratchets 3 is immovable. Again, the sealing cover 8 is stationary relative to the distributor 7. Due to the slanted degree of the third set of ratchets 71 of the distributor 7 and of the fourth set of ratchets 81 of the sealing cover 8 and the rigid connection between the driving rod 4 and the distributor 7, when the driving rod 4 is moved to the left (from viewer's degree), the driving rod 4 is forced by the fourth set of ratchets 81 of the sealing cover 8 to rotate for an degree and the spring 82 is pressed. After the driving rod 4 is moved from the consequence of the movement of the pivot pad 10, recoil force from the pressed spring 82 which is sandwiched between the sealing cover 8 the distributor 7 pushes the distributor 7 as well as the driving rod 4 back to their original positions respectively. Again, as lengths of the second set of ratchets 41 are alternately arranged, i.e., alternatively long and short, so that when teeth of the second set of ratchets 41 are abutted against teeth of the first set of ratchets 31 of the passage body 3, the driving rod 4 is forced to maintain at the current position. However, when the movement of the entire cycle repeats again to force the driving rod 4 to rotate for another predetermined degree, the teeth of the second set of ratchets 41 fall in gap between the teeth of the first set of ratchets 31 of the passage body 3 via the assistance of the recoil force of the spring 82.

From the previous description, it is learned that every time, the driving rod 4 is rotated for a previously determined degree resulting from the movement of the pivot pad 10, the block 42 either blocks the inlet 30 of the passage body 3 or keeps the inlet 30 of the passage body 3 open to allow water from the water source to flow directly out of the orifices from the bottom face of the showerhead 1.

As a result, it is noted that a gentle touch by the user activates or shuts down the waterflow out of the bottom face of the showerhead 1. As the movement, i.e., rotation, of the driving rod 4 is entirely dependent from mechanical force, there is no influence of the water pressure from the water source and the user may complete the entire operation by just a touch to the pivot pad 10.

While the invention has been described by means of specific embodiments, numerous modifications and variations could be made thereto by those skilled in the art without departing from the scope and spirit of the invention set forth in the claims.

What is claimed is:

1. A touch to open/close mechanism adapted for a showerhead having an inlet and at least one outlet in communication with the inlet to allow water from water source to flow out of the showerhead, the touch to open/close mechanism comprising:

a driving rod movably and reciprocally positioned between a first position and a second position to selectively block communication between the inlet and the outlet;

a first ratchet device adapted to be formed inside the showerhead to selectively position the driving rod at the first position and the second position;

a second ratchet device adapted to be formed inside the showerhead to force the driving rod to rotate for a previously determined degree whenever the driving rod is moved such that a block formed on an outer periphery of the driving rod is able to selectively block communication between the inlet and the outlet;

a passage body adapted to be mounted inside the showerhead; and a mounting body adapted to be mounted inside the showerhead and securely connected to the passage body to define therebetween a first chamber to receive therein the driving rod; wherein the first ratchet device is formed between the passage body and the mounting body and the second ratchet device is formed between a distributor and a sealing cover, and the first ratchet device consists essentially of a first set of ratchet formed on a side face of the passage body and a second set of ratchet formed on an outer periphery of the driving rod to selectively abutted against the first set of ratchet so as to selectively block communication between the inlet and outlet of the showerhead.

2. The mechanism as claimed in claim 1 further comprising:

a pivot pad adapted to be pivotally connected to the showerhead; and a rocking arm connected to the pivot pad to be driven to move by pivotal movement of the pivot pad and having a limiting path defined in a side face thereof to receive therein a first distal free end of the driving rod such that the driving rod is moved resulting from the movement of the rocking arm.

3. The mechanism as claimed in claim 1 further comprising a recoil force device compressed by the movement of the driving rod to selectively release a recoil force to the driving rod to return the driving rod.

4. The mechanism as claimed in claim 3 further comprising:

a pivot pad adapted to be pivotally connected to the showerhead; and a rocking arm connected to the pivot pad to be driven to move by pivotal movement of the pivot pad and having a limiting path defined in a side face thereof to receive therein a first distal free end of the driving rod such that the driving rod is moved resulting from the movement of the rocking arm;

wherein the distributor is securely attached to a side face of the mounting body and firmly connected to a second free end of the driving rod and having at least one first passage adapted to communicate with the outlet of the showerhead; wherein a free end of the recoil force device is abutted against a side face of the distributor to provide the recoil force to return the driving rod.

5. A touch to open/close mechanism adapted for a showerhead having an inlet and at least one outlet in communication with the inlet to allow water from water source to flow out of the showerhead, the touch to open/close mechanism comprising:

a driving rod movably and reciprocally positioned between a first position and a second position to selectively block communication between the inlet and the outlet;

a first ratchet device adapted to be formed inside the showerhead to selectively position the driving rod at the first position and the second position;

a second ratchet device adapted to be formed inside the showerhead to force the driving rod to rotate for a previously determined degree whenever the driving rod is moved such that a block formed on an outer periphery of the driving rod is able to selectively block communication between the inlet and the outlet;

a pivot pad adapted to be pivotally connected to the showerhead;

a rocking arm connected to the pivot pad to be driven to move by pivotal movement of the pivot pad and having a limiting path defined in a side face thereof to receive therein a first distal free end of the driving rod such that the driving rod is moved resulting from the movement of the rocking arm;

a passage body adapted to be mounted inside the showerhead;

a mounting body adapted to be mounted inside the showerhead and securely connected to the passage body to define therebetween a first chamber to receive therein the driving rod;

a distributor securely attached to a side face of the mounting body and firmly connected to a second free end of the driving rod and having at least one first passage adapted to communicate with the outlet of the showerhead; wherein a free end of the recoil force device is abutted against a side face of the distributor to provide the recoil force to return the driving rod; and a sealing cover provided to enclose therein the distributor and the recoil force device; wherein the first ratchet device is formed between the passage body and the mounting body and the second ratchet device is formed between the distributor and the sealing cover.

6. A touch to open/close mechanism adapted for a showerhead having an inlet and at least one outlet in communication with the inlet to allow water from water source to flow out of the showerhead, the touch to open/close mechanism comprising:

a driving rod movably and reciprocally positioned between a first position and a second position to selectively block communication between the inlet and the outlet;

a first ratchet device adapted to be formed inside the showerhead to selectively position the driving rod at the first position and the second position;

a second ratchet device adapted to be formed inside the showerhead to force the driving rod to rotate for a previously determined degree whenever the driving rod is moved such that a block formed on an outer periphery of the driving rod is able to selectively block communication between the inlet and the outlet;

a pivot pad adapted to be pivotally connected to the showerhead; and a rocking arm connected to the pivot pad to be driven to move by pivotal movement of the pivot pad and having a limiting path defined in a side face thereof to receive therein a first distal free end of the driving rod such that the driving rod is moved resulting from the movement of the rocking arm;

a passage body adapted to be mounted inside the showerhead;

a mounting body adapted to be mounted inside the showerhead and securely connected to the passage body to define therebetween a first chamber to receive therein the driving rod;

a distributor securely attached to a side face of the mounting body and firmly connected to a second free end of the driving rod and having at least one first passage adapted to communicate with the outlet of the showerhead; wherein a free end of the recoil force device is abutted against a side face of the distributor to provide the recoil force to return the driving rod;

a sealing cover provided to enclose therein the distributor and the recoil force device; and a recoil force device sandwiched between the distributor and the sealing cover to be compressed by the movement of the driving rod to selectively release a recoil force to return the driving rod, wherein the first ratchet device is formed between the passage body and the mounting body and the second ratchet device is formed between the distributor and the sealing cover, the first ratchet device consists essentially of a first set of ratchets formed on a side face of the passage body and a second set of ratchets formed on an outer periphery of the driving rod to selectively abutted against the first set of ratchets so as to selectively block communication between the inlet and outlet of the showerhead, the second ratchet device consists essentially of a third set of ratchets formed on a side face of the distributor and a fourth set of ratchets formed on a side face of the sealing cover to correspond to the third set of ratchets of the distributor to force the distributor as well as the driving rod to rotate for a previously determined degree.

* * * * *